US006345732B1

(12) United States Patent
Zimmerman et al.

(10) Patent No.: US 6,345,732 B1
(45) Date of Patent: Feb. 12, 2002

(54) WATER GUN WITH REMOVABLE PRE-PRESSURIZABLE CARTRIDGE

(75) Inventors: Jeffrey Zimmerman, King of Prussia, PA (US); George L. Skinner, Lake Hiawatha, NJ (US)

(73) Assignee: Larami Limited, Mt. Laurel, NJ (US)

( * ) Notice: Subject to any disclaimer, the term of this patent is extended or adjusted under 35 U.S.C. 154(b) by 0 days.

(21) Appl. No.: 09/592,498

(22) Filed: Jun. 12, 2000

Related U.S. Application Data

(60) Provisional application No. 60/138,887, filed on Jun. 11, 1999, and provisional application No. 60/162,579, filed on Oct. 29, 1999.

(51) Int. Cl.[7] ..... A63H 3/18
(52) U.S. Cl. ..... 222/79; 446/473
(58) Field of Search ..... 222/79; 446/473

(56) References Cited

U.S. PATENT DOCUMENTS 5,074,437 A * 12/1991 D'Andrade et al. ..... 222/79
6,138,871 A * 10/2000 D'Andrade ..... 222/79

* cited by examiner

*Primary Examiner*—J. Casimer Jacyna
(74) *Attorney, Agent, or Firm*—Akin, Gump, Strauss, Hauer & Feld, L.L.P.

(57) ABSTRACT

Toy water guns having removable pre-pressurizable water cartridges and the pre-pressurizable cartridges themselves and water charging systems for them. More particularly, the present invention is directed to a toy water gun having a pre-pressurizable water cartridge which can be charged using a pump located on the water gun or an auxiliary adapter connected to an external pressurized water source for quickly charging the pre-pressurizable water cartridge either installed in the water gun or separately, the pre-pressurizable water cartridges, recharge adapters and methods of filling the pre-pressurizable cartridges when installed in a water gun and when removed from a water gun.

24 Claims, 9 Drawing Sheets

FIG. 3
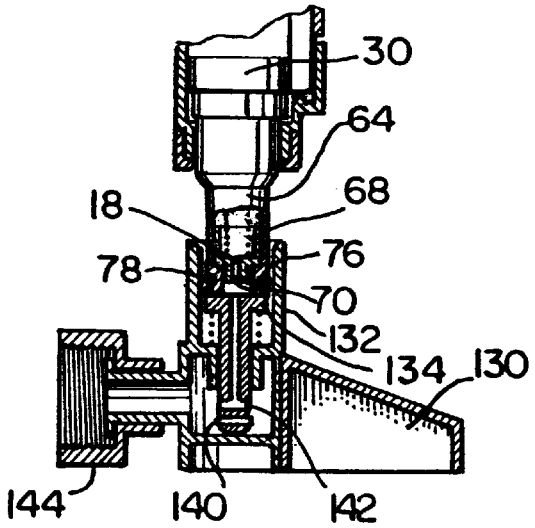
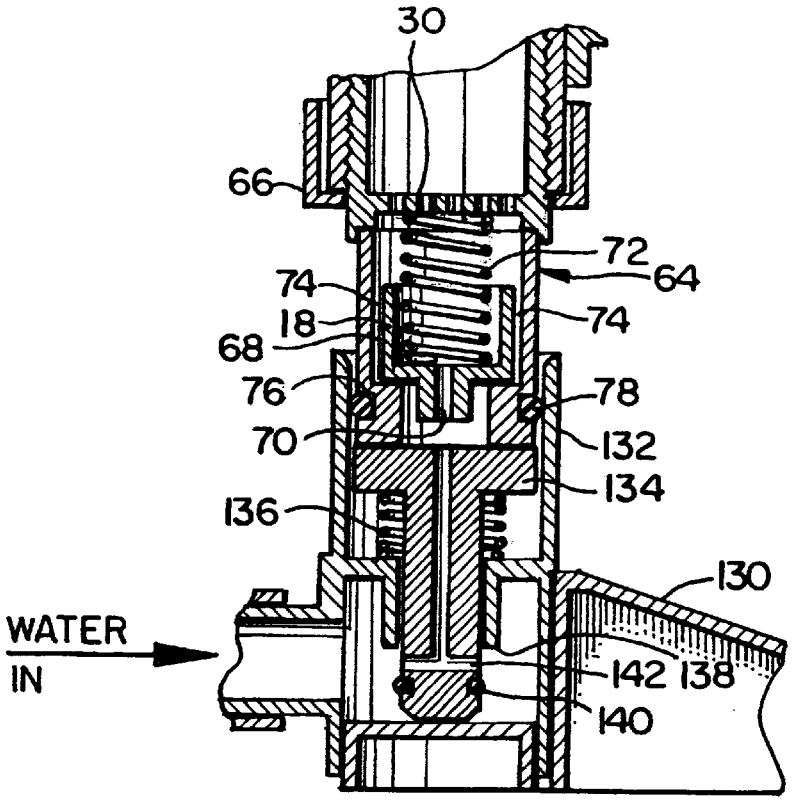
FIG. 4

WATER GUN WITH REMOVABLE PRE-PRESSURIZABLE CARTRIDGE

RELATED APPLICATION

This application claims the benefit of U.S. Provisional Patent Application Nos. 60/138,887, filed Jun. 11, 1999, and 60/162,579, filed Oct. 29, 1999.

BACKGROUND OF THE INVENTION

The present invention is directed to toy water guns having removable pre-pressurizable water cartridges and the pre-pressurizable cartridges themselves and water charging systems for them. More particularly, the present invention relates to a toy water gun having a pre-pressurizable water cartridge which can be charged using a pump located on the water gun or an auxiliary adapter connected to an external pressurized water source for quickly charging the pre-pressurizable water cartridge either installed in the water gun or separately.

Water guns having an onboard water reservoir which can be pressurized with air are known. Such guns typically utilize a pump located on the water gun which can be used to pump air into the water reservoir in order to pressurize the water therein such that when the trigger is pulled, a stream of water is ejected from the water gun that lasts as long as the trigger is engaged or until the pressure of the water equals ambient pressure. One such water gun is disclosed in prior U.S. Pat. No. 5,074,437, assigned to the assignee of the present invention. It is also known to provide such a water gun which can be rapidly charged without the need for pumping if an external pressurized water source, such as a municipal water supply, is available. Such a water gun is disclosed in U.S. patent application Ser. No. 09/227,061, filed Jan. 5, 1999, which is assigned to the assignee of the present invention and is incorporated herein by eference as if fully set forth. Such water guns have proven to be extremely popular and successful in the market.

It would be desirable to provide a water gun that can be quickly recharged and or refilled in order to eliminate the need for the user to return to a water source every time the water gun requires refilling. This would provide for enhanced enjoyment and ease of use. It would also be desirable to maintain the ability to rapidly charge the water gun from a source of pressurized water, when available for younger users who may have more difficulty using the manual pump. Additionally, it would desirable to maintain the ability to pressurize the water gun when an external source of pressurized water is not available.

It would also be desirable to provide a removable, pre-pressurizable water cartridge for a toy water gun which can be quickly recharged and or refilled in order to eliminate the need for the user to return to a water source every time the water gun requires refilling. This would provide for enhanced enjoyment and ease of use. It would also be desirable to be able to remove a "spent" cartridge from the water gun and rapidly insert a pre-pressurized replacement cartridge without the need to refill the spent cartridge in order to continue using the water gun.

BRIEF SUMMARY OF THE INVENTION

One aspect of the present invention relates to a toy gun for discharging a fluid under pressure, the toy gun comprising:

a housing;

a trigger movably connected to the housing;

a pre-pressurizable fluid storage cartridge removably connected to the housing, the fluid storage cartridge being pressurizable with a fluid prior to connecting the fluid storage cartridge to the housing;

a release valve fluidly connected to the fluid storage cartridge and connected to the trigger to permit a discharge of fluid from the toy gun;

a nozzle in fluid communication with the release valve; and a path of fluid communication connected between the fluid storage cartridge and the release valve;

wherein operation of the trigger discharges pressurized fluid from the fluid storage cartridge through the path of fluid communication and through the nozzle.

Another aspect of the present invention relates to a toy gun system adapted to discharge a stream of liquid under pressure, comprising:

a toy gun and a recharging adapter, the toy gun including:

a housing;

a nozzle assembly at a discharge end of the housing;

a pump connected to the housing;

a pre-pressurizable fluid storage cartridge removably connected to the housing;

a path of fluid communication connected between the fluid storage cartridge and the nozzle; and the recharging adapter including:

a receptacle adapted to receive the nozzle assembly;

a valve body slidably disposed in the receptacle;

a fluid channel located in the valve body; and a connector adapted for connection to an external source of pressurized liquid, wherein insertion of the nozzle assembly of the toy gun into the receptacle of the recharging adapter displaces the valve body to an open position, and allows fluid from an external source of pressurized fluid to travel through the valve body, the nozzle assembly and the path of fluid communication and into the fluid storage cartridge, pressurizing fluid in the storage cartridge and wherein insertion of the charge valve assembly of the cartridge, which has been removed from the toy gun housing, into the receptacle of the recharge adapter allows fluid from the external source of pressurized fluid to travel through the charge valve assembly and into the fluid storage cartridge, pressurizing fluid in the storage cartridge.

Still another aspect of the present invention relates to a method of operating a toy gun system comprising the steps of:

(a) providing a toy gun having a housing, a pre-pressurizable fluid storage cartridge removably connected to the housing and having a charge valve assembly, a nozzle, a pump, and a path of fluid communication between the cartridge, the nozzle, and the pump;

(b) pressurizing air within the fluid storage cartridge by at least one of:

(i) pumping air via the pump to the fluid storage cartridge;

(ii) inserting the nozzle in a receptacle of a recharging adapter and allowing pressurized fluid to flow from the recharging adapter through the nozzle and into the fluid storage cartridge; and (iii) inserting the charge valve assembly of the fluid storage cartridge which has been removed from the housing into the receptacle of the recharging adapter and causing the charge valve assembly to open to allow pressurized fluid to flow from the recharging adapter into the fluid storage cartridge, removing the fluid storage cartridge from the recharging adapter and inserting the fluid storage cartridge into the gun;

(c) discharging the cartridge by displacing the release valve via a trigger connected to the release valve to eject a stream of fluid from the toy gun; and (d) recharging the toy gun in accordance with step (b).

Yet another aspect of the present invention relates to a fluid cartridge comprising:

a cartridge bottle having an opening, the cartridge bottle adapted to receive and store pressurized fluid; and a first valve connected to the cartridge bottle and operable to seal the opening and releasably maintain a pressurized condition within the cartridge bottle, the first valve adapted to allow fluid flow into and out of the cartridge bottle;

the fluid cartridge being adapted for connection with a fluid discharge device, whereupon actuation of the fluid discharge device discharges fluid from the fluid cartridge.

Still another aspect of the present invention relates to a method of filling a fluid cartridge comprising the steps of:

(a) providing a fluid cartridge having a cartridge bottle and a manifold releasably connected to the cartridge bottle, the manifold including a first valve; and (b) filling and pressurizing the fluid cartridge by at least one of:

(i) inserting the first valve into a recharging adapter, allowing pressurized fluid to flow from the recharging adapter into the fluid cartridge, and removing the fluid cartridge from the recharging adapter in one instance;

(ii) inserting the cartridge into a toy water gun having a nozzle assembly and inserting the nozzle assembly into a receptacle of a recharging adapter and allowing pressurized fluid to flow from the recharging adapter through the nozzle assembly and into the fluid cartridge in another instance; and (iii) removing the manifold from the cartridge bottle, adding fluid into the cartridge bottle, and reconnecting the manifold to the cartridge bottle, and pumping air into the cartridge through the manifold in a third instance.

Yet another aspect of the present invention is, in combination, a fluid discharge device and a fluid discharge cartridge, the fluid discharge cartridge including:

a cartridge bottle having an opening, the cartridge bottle adapted to receive and store pressurized fluid; and a first valve connected to the cartridge bottle and operable to seal the opening and releasably maintain a pressurized condition within the cartridge bottle, the first valve adapted to allow fluid flow into and out of the cartridge bottle;

the fluid cartridge being insertable into the fluid discharge device, whereupon actuation of the fluid discharge device discharges fluid from the fluid cartridge.

Still another aspect of the present invention relates to a quick charge device comprising:

a pressurized water chamber;

a receptacle connected to the chamber adapted to receive a nozzle assembly of a toy gun;

an attachment for connection to an external source of pressurized liquid in fluid communication with the chamber;

a valve body slidably disposed in the receptacle, wherein the valve body in the receptacle is adapted to be displaced by the nozzle assembly of the toy gun to an open position allowing liquid from the external source of pressurized liquid to travel into the nozzle assembly of the toy gun; and a release valve in fluid communication with the chamber; the release valve being operable between a closed position wherein pressurized fluid is retained within the quick charge device and an open position wherein the pressurized fluid is released from the quick charge device.

Yet another aspect of the present invention relates to method of filling a water gun utilizing a quick charge device having a first valve with a quick fill receptacle and a second valve, the method comprising:

(a) connecting the quick charge device to a source of pressurized fluid; and (b) filling the water gun by discharging the pressurized fluid through the quick charge device by:

(i) in one instance inserting a charge nozzle on a toy water gun into the quick fill receptacle of the first valve of the quick charge device; and (ii) in a second instance opening the second valve and allowing the pressurized fluid to discharge from the second valve into the water gun.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 3 is a partial elevational view, partially in cross-section, of the nozzle of the toy water gun shown in FIG. 1 being inserted into a recharge adapter in accordance with the present invention;

FIG. 4 is a greatly enlarged elevational view, partially in cross-section, of a portion of FIG. 3;

DETAILED DESCRIPTION OF THE INVENTION

Figure 1:
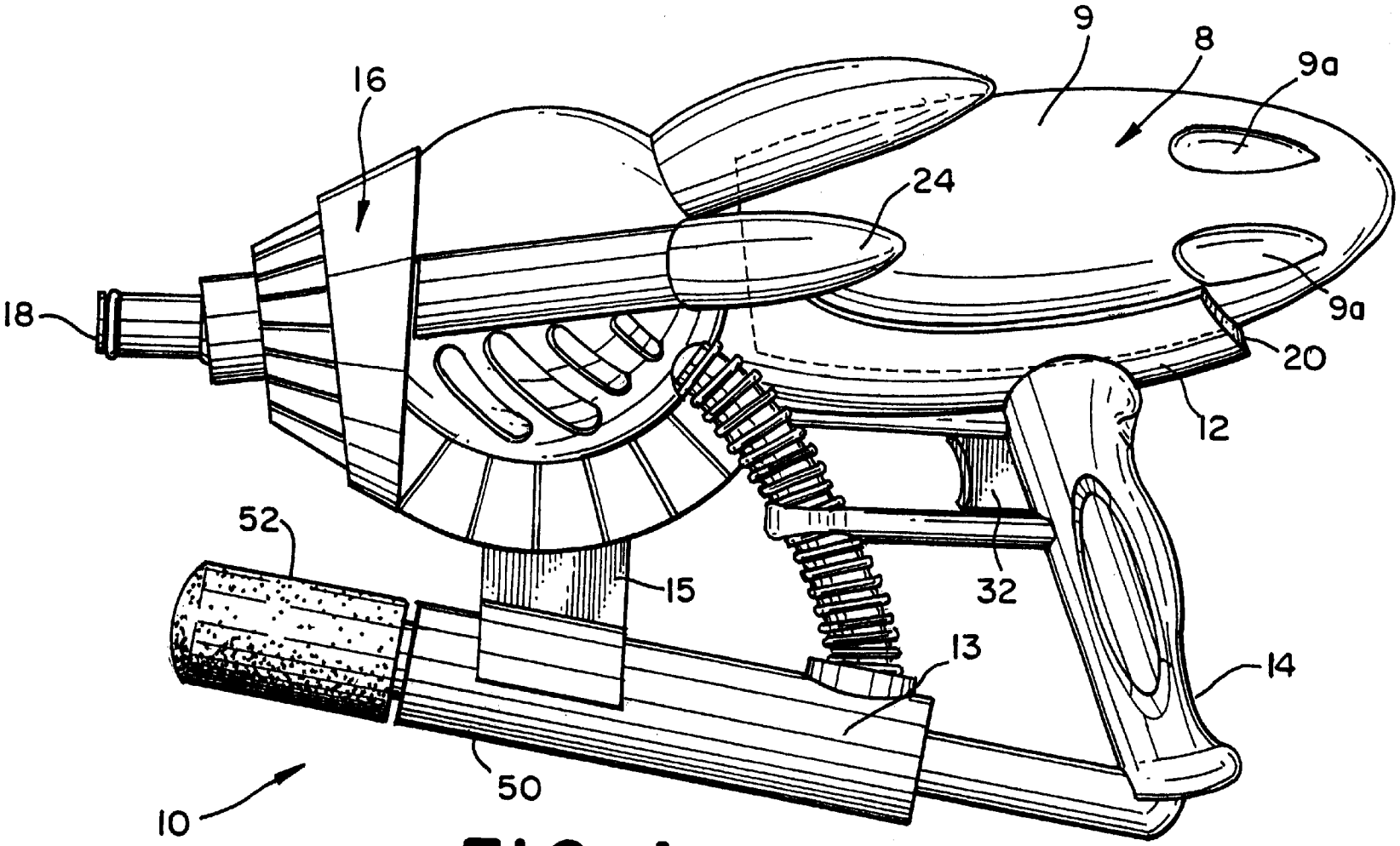
FIG. 1 is a left side elevational view showing one embodiment of a water gun in accordance with the present invention.

Certain terminology is used in the following description for convenience only and is not limiting. The words "right," "left," "lower" and "upper" designate directions in the drawings to which reference is made. "Left" and "right", with respect to the description of the sides of the water gun noted above in the brief description of FIGS. 1, 1A, 2 and 2A, refers to the respective side of the water gun as one would view it looking from the rear toward the front of the gun. The words "inwardly" and "outwardly" refer to directions toward and away from, respectively, the geometric center of the toy water gun in accordance with the present invention, and designated parts thereof. The word "a" is defined to mean "at least one", unless otherwise specifically stated or as would be clearly only one in the context in which it is used. The terminology includes the words noted above as well as derivatives thereof and words of similar import.

Figure 2:
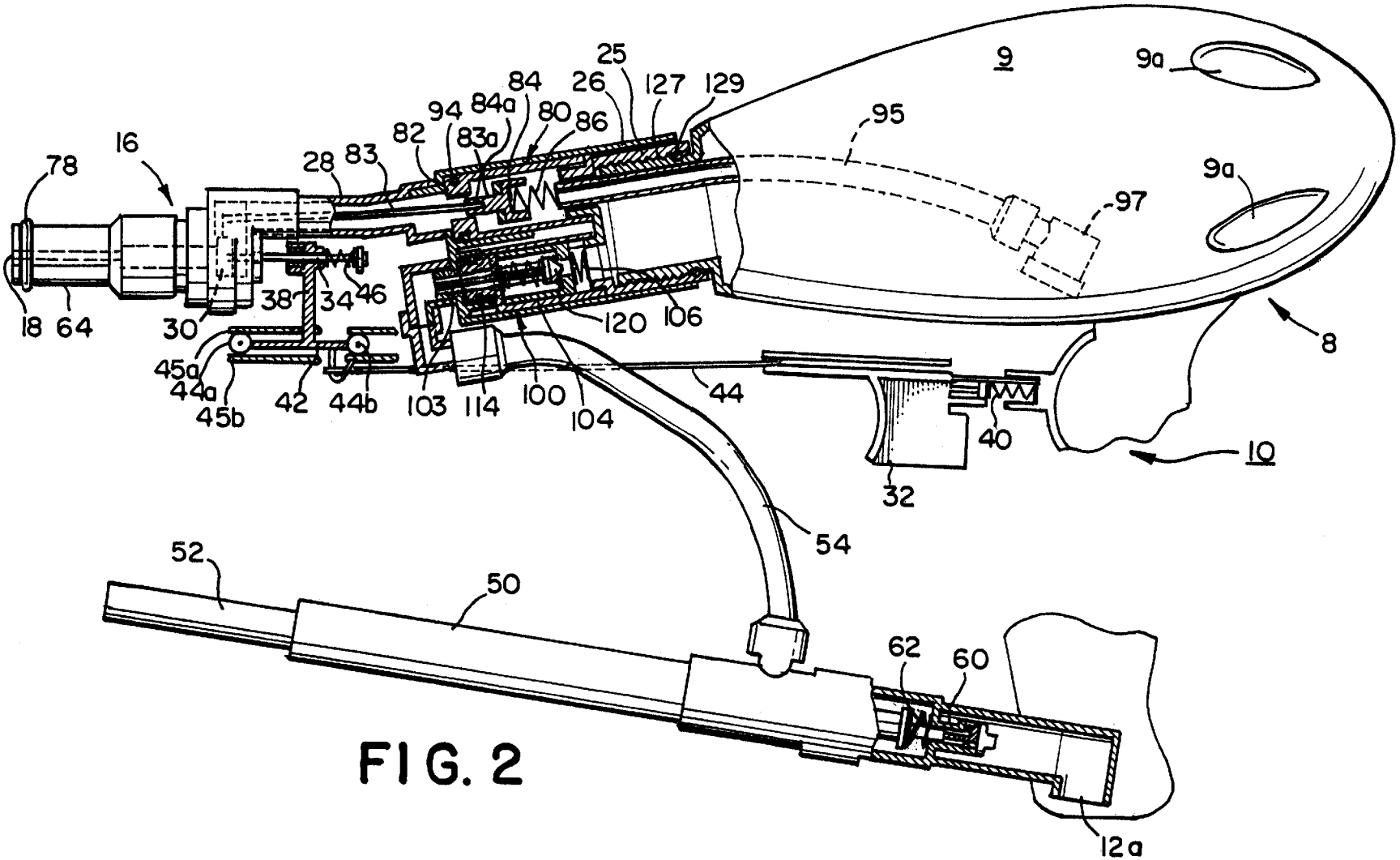
FIG. 2 is a left side elevational view, partially in vertical cross-section and with the housing removed, of the water gun in accordance with the present invention shown in FIG. 1.

Referring to the drawings, wherein like numerals indicate like elements throughout, there is shown in FIGS. 1 and 2 a toy water gun 10 for discharging a fluid under pressure in accordance with a preferred embodiment of the present invention having a removable, pre-fillable and/or pre-pressurizable cartridge 8. While the preferred embodiment of the invention preferably includes the cartridge 8 connected to the water guns, it will be recognized by those skilled in the art in view of the present disclosure that the cartridge 8 can be connected to other pressurized fluid release systems and the cartridge 8 can be used with any fluid. For the sake of convenience, the preferred embodiment will therefore be described as a water gun, although this is not intended to limit the present invention from use with other fluids. The water gun 10 operates in a similar manner to the water gun disclosed in prior U.S. Pat. No. 5,074,437, which is incorporated herein by reference as if fully set forth. As shown in FIG. 1, the water gun 10 includes a main housing 12 having a handle 14 which can be grasped by a user's hand. A support 15 is located forward of the handle 14 which can be grasped by the user's other hand, if desired. A pump housing 13 is supported between the handle 14 and the support 15.

Figure 2A:
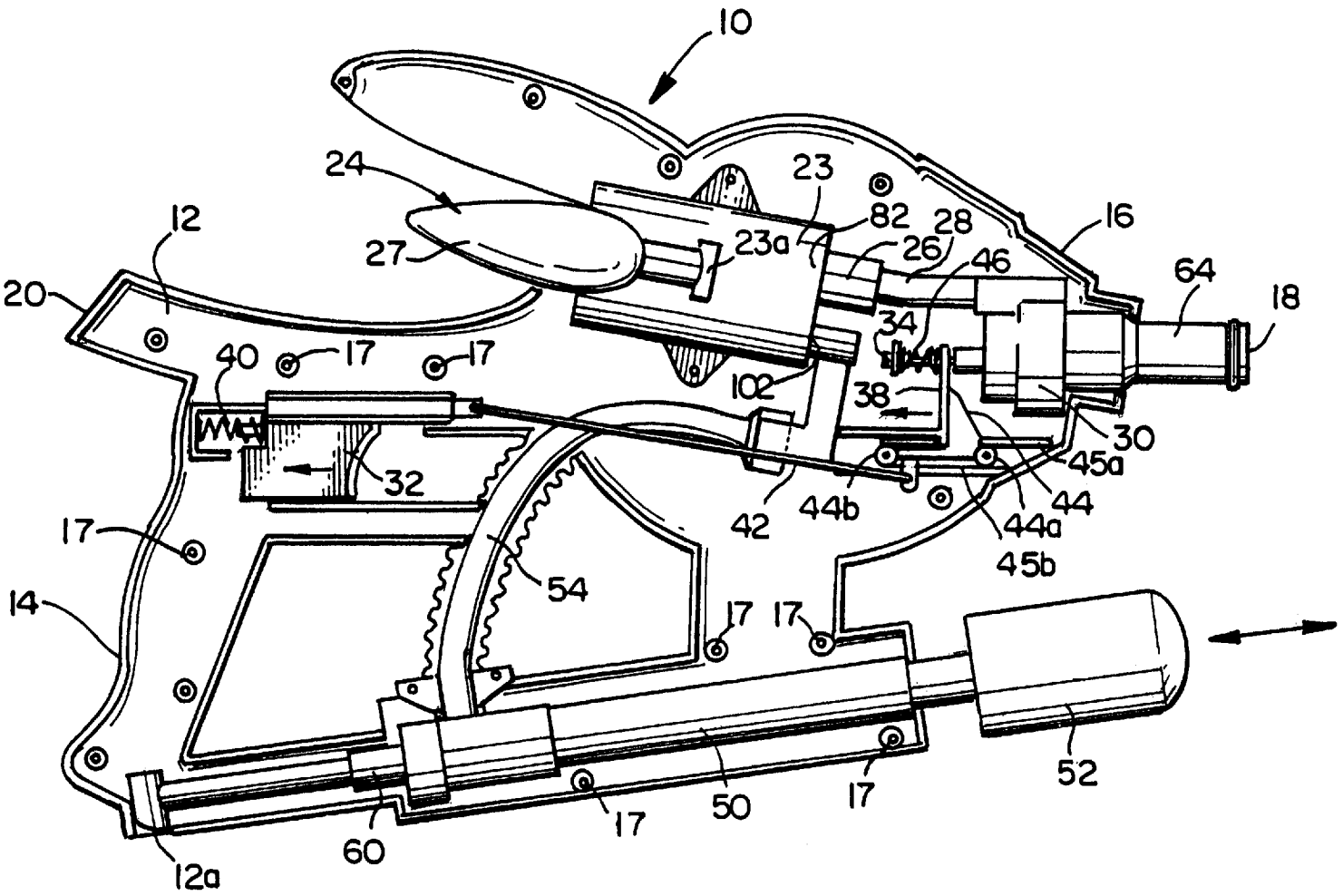
FIG. 2A is a right side elevational view with half of the housing removed and the cartridge removed.

Preferably, the housing 12 the handle 14, and the support 15 are molded from a polymeric material in one or more pieces, and are assembled together to form the housing 12. The ornamental appearance of the housing 12, handle 14 and support 15 is not important for the functioning of the water gun, and many of the details of the housing, handle and support as illustrated in the drawings are merely ornamental. The functional aspects of the functional components will be described in sufficient detail to enable a person skilled in the art to make and use the present invention, while creating such ornamental designs as desired without adversely affecting the function or operation of any component or subassembly. A plurality of female screw posts 17 (some of which have not been numbered for the sake of clarity) have screw receiving holes in them and extend in a sufficient number at appropriate places from the interior surface of the left side of the gun as illustrated in FIG. 2A to facilitate connecting the housing halves together. Each of the screw posts 17 is preferably molded to form a unitary structure with one of the housing halves. The screw posts 17 receive screws passing through mating screw holes formed in the right or other half of the housing to connect the housing halves together.

Preferably, the cartridge 8 includes a cartridge bottle 9, which is also made of a polymeric material and may be blow molded, as well as a cartridge manifold 25, described in detail below. It will be recognized by those skilled in the art from the present disclosure that the housing 12, the handle 14, support 15, pump housing 13, and the cartridge bottle 9 may be made using any desired method, such as machining or casting, and from any suitable material, as desired.

Figure 5:
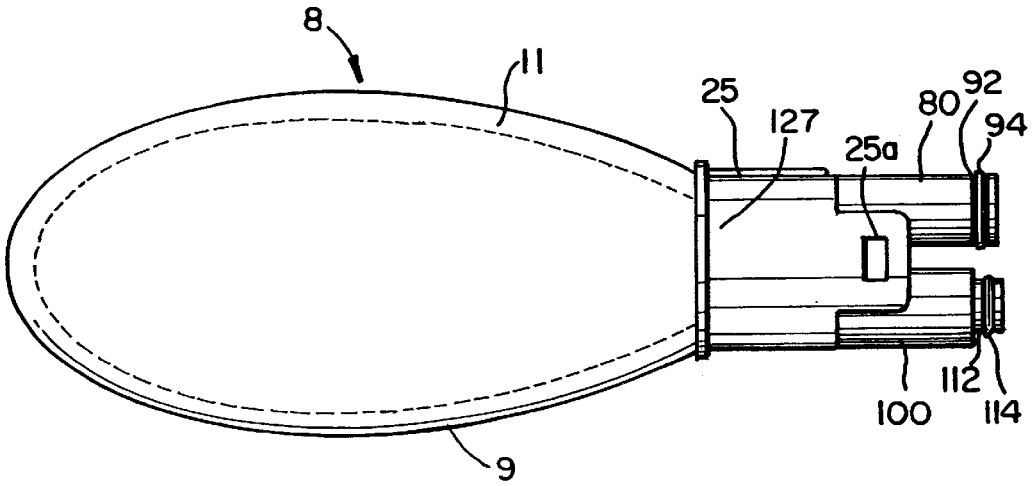
FIG. 5 is a side elevational view of a fluid cartridge in accordance with the present invention.

As shown in FIG. 5, as an alternative to air pressure being solely utilized to pressurize the liquid, an elastic bladder 11 (in phantom) can be provided within the cartridge bottle 9. The bladder 11 can be similar to any number of bladders well known to those skilled in the art for use in water guns. The preferred bladder is a type disclosed in U.S. Pat. No. 6,012,609, which is assigned to the assignee of the present invention and is incorporated herein by reference as if fully set forth. The bladder 11 provides motive force for ejecting fluid from the cartridge 8 under pressure. However, those skilled in the art will recognize that other bladders can be used and that the bladder 11 is not required. The cartridge bottle 9 will hereinafter be described without reference to the bladder.

Figure 1A:
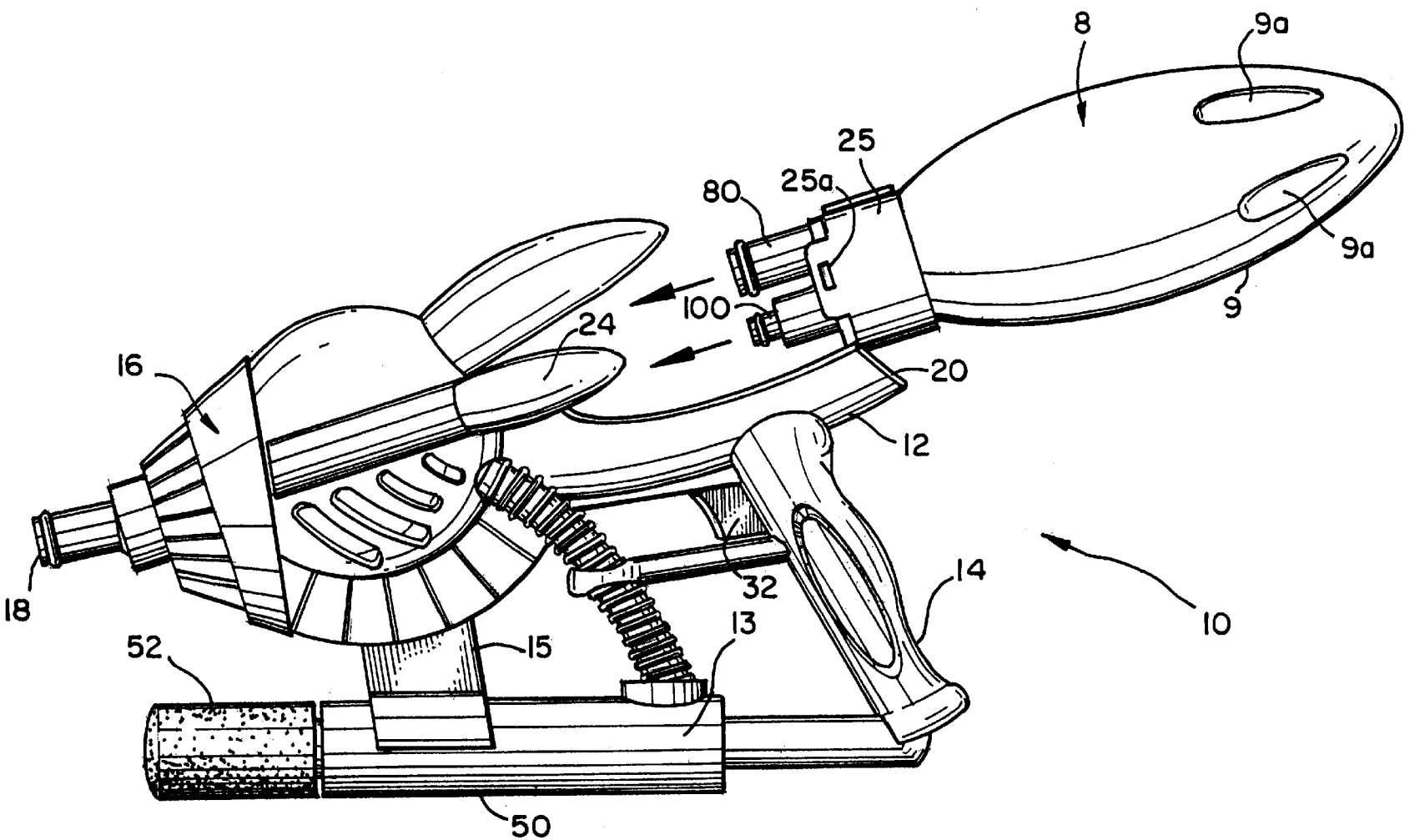
FIG. 1A is an exploded left side elevational view similar to FIG. 1 showing installation of the water gun cartridge on the water gun.

As seen in FIGS. 1, 1A and 2, the housing 12 includes a front or discharge end 16 which supports a nozzle 18, and a rear end 20 which houses the removable, pre-fillable and/or pre-pressurizable fluid storage cartridge 8 removably connected to the housing 12. The cartridge 8 is pressurizable with a fluid either prior to connecting the cartridge 8 to the housing 12 or after the cartridge 8 is connected to the housing 12. The cartridge 8 is preferably releasably and fluidly connected to the housing via a spring operated quick release connection 24 to a water gun manifold 26 located inside the housing 12.

Figure 8:
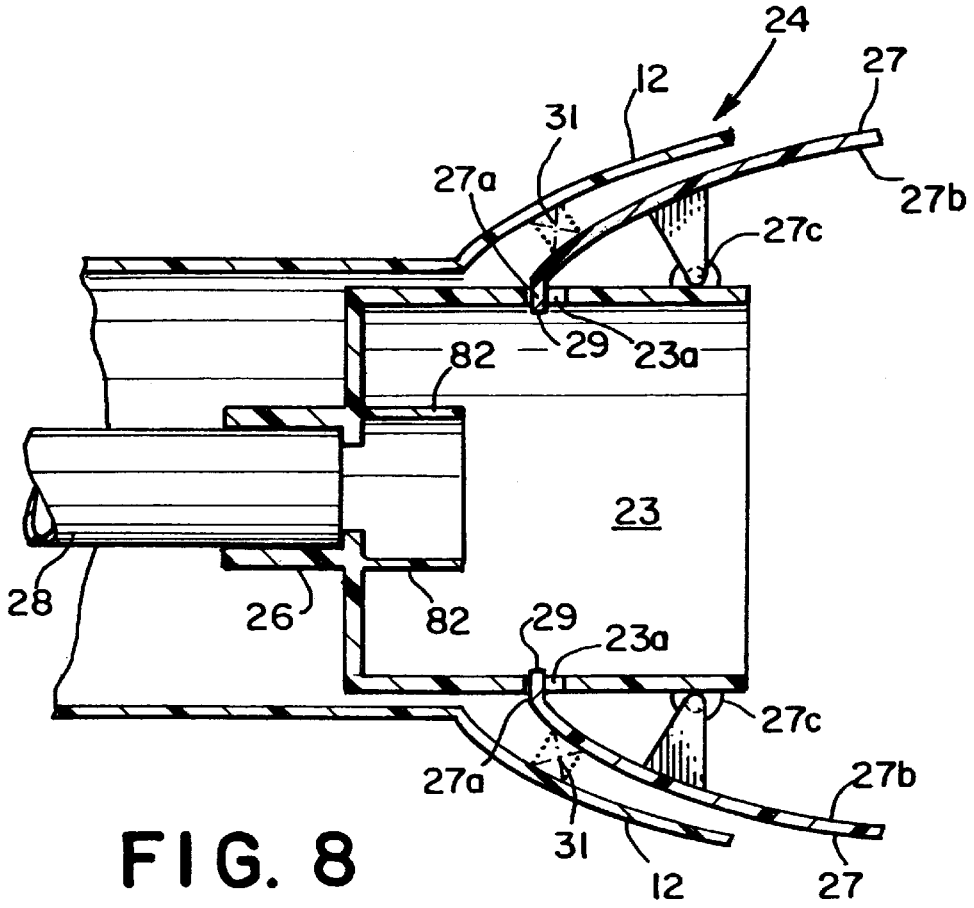
FIG. 8 is a partial top plan view of a water gun cartridge quick-release mechanism in accordance with the present invention.

As seen in FIG. 8, the quick release connection 24 includes a lock arm 27 pivotally mounted by pivotable connectors 27*c* on each side of a cartridge receiver 23. Each lock arm 27 includes a tang 29 located at a first free end 27*a* of the arm 27. The tang 29 is extendable through an opening 23*a* in the cartridge receiver 23. A lock arm spring 31 is biased between the housing 12 and each first free end 27*a* of the arm 27 such that the tang 29 is biased into the opening 23*a* in the cartridge retainer 23. Preferably, the lock arm spring 31 is a helical spring, although those skilled in the art will recognize that springs other than helical compression springs can be used, such as leaf springs, for instance. A second free end 27*b* of each arm 27 extends generally outward and rearward from the housing 12. Although a spring operated quick release connection 24 having two lock arms 27 is preferred, those skilled in the art will realize in view of the present disclosure that only one or more than two lock arms 27 could be utilized or other types of quick release connections can be used to connect the cartridge 8 to the cartridge receiver 23, such as a spring-detent mechanism, a form fit snap connection, etc.

Referring to FIG. 5, preferably, the cartridge 8 is generally oblong in shape to facilitate insertion into the housing 12.

However, those skilled in the art will recognize from the present disclosure that the cartridge 8 can be any other shape without departing from the scope of the present invention. The cartridge 8 includes the cartridge bottle 9 and the cartridge manifold 25. The cartridge manifold 25 includes an indentation or notch 25*a* on either side of the exterior of the cartridge manifold 25. Each notch 25*a* is located and sized so as to be engaged by one of the tangs 29, such that the tangs 29 extend through the notches 25*a* and retain the cartridge 8 in the housing 12. Preferably, the notches 25*a* are located on the body of the manifold 25, although those skilled in the art will recognize that the notches 25*a* can also be located on the cartridge bottle 9. It will be recognized by those skilled in the art from the present disclosure that only one notch or more than two notches 25*a* could be utilized, if desired. Preferably, the cartridge bottle 9 includes a plurality of raised grips 9*a* spaced around the outer circumference of the cartridge bottle 9. The raised grips 9*a* enable the user to obtain a firm grip on the cartridge 8 when removing the cartridge 8 from the housing 12.

The cartridge manifold 25 is replaceably removable from a threaded opening of the cartridge bottle 9 to allow the cartridge bottle 9 to be filled with unpressurized water as will be more fully described later herein. The cartridge manifold 25 includes a threaded portion 127, which is threadably connected to the cartridge bottle 9 by mating threads 128 on the cartridge bottle, best seen in FIG. 5A. An O-ring 129 assures a leak-free seal between the bottle 9 and the cartridge manifold 25.

Figure 7:
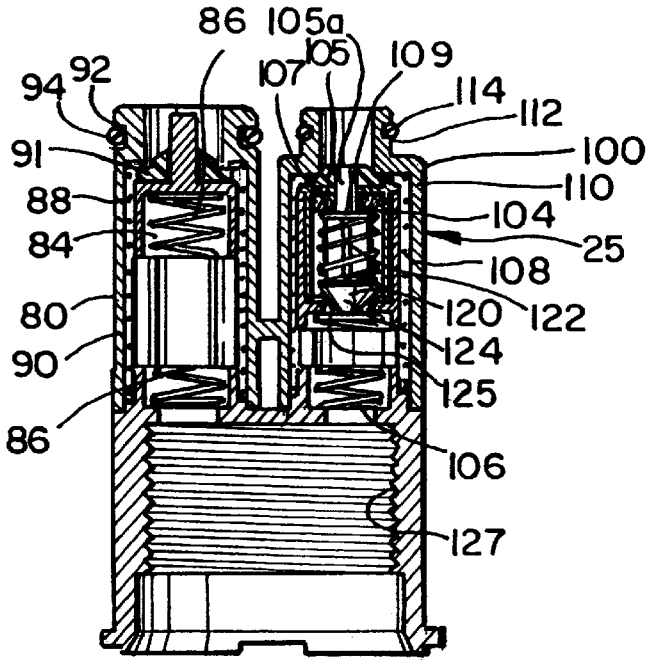
FIG. 7 is a cross-sectional view taken along lines 7—7 in FIG. 6.

Referring to FIGS. 2 and 7, the cartridge manifold 25 further includes a charge valve assembly 80 and a pump valve assembly 100 as will be described in more detail below.

As shown in FIGS. 2 and 2A, a first path of fluid communication between the inserted or installed cartridge 8 and the nozzle 18 inside the housing 12 is made up of a conduit 28 and a passage through the water gun manifold 26 located in the base of the receiver 23. The conduit 28 can be made by any desired method from any suitable material in any manner as long as the conduit 28 has the ability to deliver fluid from one end to the other. The manifold 26 is fluidly connected via the conduit 28 to a release valve 30 connected to and controlling fluid flow through the nozzle 18. The release valve 30 is similar to the valve disclosed in U.S. Pat. No. 5,799,827 which is assigned to the assignee of the present invention and is incorporated herein by reference as if fully set forth.

The release valve 30 is actuated via a trigger 32 which is connected to the release valve 30 and is movably connected to the housing 12 for sliding movement adjacent to the handle 14. A valve stem 34 extends from the release valve 30 for opening the release valve 30 to discharge water or any other desired fluid from the nozzle 18 which is in fluid communication with the release valve 30. Operation of the trigger 32 moves a linkage that causes the valve stem 34 in the release valve 30 to be retracted, opening the release valve 30 and thereby providing a discharge of pressurized water from the cartridge 8 which passes through the first path of fluid communication and is ejected from the water gun 10 as a stream from the nozzle 18. The trigger 32 is biased to a first position via a first spring 40. The trigger 32 is connected to the valve stem 34 by an arm 42 that is connected to an actuator trolley 44, in turn connected to a valve actuator 38, which is operatively connected to the valve stem 34. As shown in FIG. 2 and 2A, the actuator trolley 44 is located inside the housing 12 and includes pairs of front and rear rollers 44*a*, 44*b*, respectively, which roll within a track 45, which is integral with and preferably molded or otherwise formed unitarily as a single structure with the interior of the housing 12. Preferably, the track 45 includes upper and lower track portions 45*a*, 45*b* between which the rollers 44*a*, 44*b* roll. The upper and lower track portions 45*a*, 45*b* guide the actuator trolley 44 as it reciprocates between a forward position when the trigger 32 is released and a rearward position when the trigger 32 is depressed against the force of the first spring 40.

Preferably, a delay spring 46 is located between the trigger valve actuator 38 attached to the actuator trolley 44 and the valve stem 34 and operates in the same manner as disclosed in U.S. Pat. No. 5,799,827. However, it will be recognized by those skilled in the art from the present disclosure, that other types of release valves may be used, such as a pinched tube valve or a valve assembly not including the delay spring 46, and that the present invention is not limited to the specific valve or trigger arrangement disclosed.

A pump 50 is connected to the housing 12 and is preferably located in the pump housing 13. The pump 50 includes a pump handle 52 that preferably extends from the front of the water gun 10. The pump can be designed such that the handle 52 may extend in any other direction besides the front, if desired. The pump handle 52 is connected to a piston rod that in turn is connected to a piston that reciprocates within a piston chamber, all of which are well known for use in water gun pumps. The pump 50 is fluidly connected to the cartridge 8 via a second path of fluid communication comprising a pump pipe 54 that is connected to the manifold 26. The pump handle 52 can be grasped by a user's hand to manually pump air into the cartridge 8 for charging the cartridge 8 by transferring air into the cartridge 8 through the pump valve assembly 100, pressurizing fluids (i.e. air and water) located therein. The pump 50 may be of any type, including various types of reciprocating piston pumps or even a battery operated pump if desired, and may be integral with and firmly or rigidly connected to the gun, such as by the gun handle 14 and a support 15, or otherwise, such as being located within or attached to the housing 12. Alternatively, the pump may be a separate or a separable pump, connected to and in fluid communication with the water gun only by a flexible pipe. Various portable pumps are also well known for use with water guns.

A pump pressure release valve 60, which is set at a desired pressure in order to prevent over-pressurization of the water gun 10, is connected to the pump pipe 54. Preferably, the pump pressure release valve 60 includes a second spring 62, schematically shown in FIG. 2, which normally biases the pump pressure release valve 60 to a closed position and opens when acted upon by a sufficient pressure. It will be recognized by those skilled in the art from the present disclosure that the pump pressure release valve 60 may be set at any desired value in order to prevent over-pressurization of the water gun 10 from the pump 50. The pump pressure release valve 60 discharges over-pressurized air or water from the water gun 10 via a vent opening 12*a*, which, for example, may be located conveniently in the pump housing 13, near the gun handle 14, as shown in FIG. 2.

Still with reference to FIG. 2, a nozzle assembly 64, including the nozzle 18, is located at the discharge end 16 on the front of the water gun 10 and is in fluid communication with the cartridge 8 through the gun release valve 30, the conduit 28 and the manifold 26. The nozzle assembly 64, which allows quick charging of the water gun 10, is shown in detail in FIGS. 3 and 4 in the charging position in a recharge adapter 130 or quick charge device. The nozzle assembly 64 is adapted for insertion into the recharge adapter 130 or a recharge adapter 230, shown in FIGS. 10 and 11, as explained in detail below, to force liquid through the nozzle assembly 64 to displace the gun release valve 30, such that liquid flows through the first path of fluid communication including the conduit 28, the manifold 26, the pump valve assembly 100, and into the cartridge 8.

As shown in FIG. 4, the nozzle assembly 64 further includes a nozzle housing 66. A sliding nozzle member 68 is slidably located in the nozzle housing 66 and a nozzle discharge opening 70 is located in the sliding member 68. The discharge opening 70 has a first size. The sliding nozzle member 68 is biased by a third spring 72 to a normally closed, forward-most position within the nozzle housing 66. The sliding nozzle member 68 includes at least one recharge channel 74 located between the sliding nozzle member 68 and the nozzle housing 66.

As shown in detail in FIG. 4, preferably a plurality of recharge channels 74 are located around the periphery of the sliding nozzle member 68 to allow for an increased flow area between the sliding nozzle member 68 and the wall of the housing 66 during recharging as the sliding nozzle member 68 is moved rearwardly in the nozzle housing 66 by the force of the externally pressurized water. The at least one recharge channel 74 is a different size, preferably having a larger area, than the discharge opening 70, to admit water more readily into the water gun. The third spring 72 is positioned to bias the sliding nozzle member 68 to a first position to block the recharge channels 74 during water gun use. As explained in detail below, the sliding nozzle member 68 is adapted to move to a second position during recharging to open the recharge channels 74. The outside of the nozzle housing 66 includes a groove 76 for a first O-ring seal 78. Alternatively, if desired, the O-ring seal can be disposed in an inner circumferential groove within the recharge adapter, instead of around the nozzle housing 66. However, it will be recognized by those skilled in the art from the present disclosure that different types of valve assemblies can be utilized, and that the sliding nozzle member 68 can be omitted, if desired. The discharge opening 70 is generally sealed by the gun release valve 30 except during recharging through the nozzle assembly 64 or during firing of the water gun 10.

As depicted in FIGS. 2 and 7, the cartridge manifold 25 includes a charge valve assembly 80 and a pump valve assembly 100. The charge valve assembly 80 is compatible with and insertable into both a charge valve receiver 82 in the gun manifold 26 and the quick charge device 130. The charge valve assembly 80 includes a charge valve assembly housing 90. The outside of the charge valve assembly housing 90 includes a groove 92 for another O-ring seal 94 at the forward end. This assures a leak-free seal between the charge valve assembly housing 90 and the charge valve receiver 82.

A sliding charge valve member 84 having an extension 84*a* is located in the charge valve assembly 80. The sliding charge valve member 84 is biased by a fourth spring 86 to a forward-most, first position within the charge valve assembly 80. The charge valve member 84 includes at least one charge valve channel 88 located between the sliding charge valve member 84 and a charge valve assembly housing 90.

An opening 88, preferably formed by a plurality of recharge channels, is located around the periphery of the sliding charge valve member 84, to allow for an increased flow area between the sliding charge valve member 84 and the charge valve assembly housing 90 during recharging as the sliding charge valve member 84 is moved rearwardly in the charge valve assembly housing 90. A seal 91 is located on the charge valve member 84 between the charge valve member 84 and the charge valve assembly housing 90 to provide a seal between the charge valve member 84 and the charge valve assembly housing 90 when the charge valve member 84 is in the first, closed position. The fourth spring 86 is positioned to bias the sliding charge valve member 84 to the first, normally closed position to block the recharge opening 88. It will be recognized by those skilled in the art from the present disclosure that different types of charge valve assemblies can be utilized.

A stem 83, located within the receiver 82 of the gun manifold 26, extends rearwardly from the release valve 30 into the insertion path of the charge valve assembly 80 and into the path of fluid communication toward the charge valve member 84. The stem 83 moves in conjunction with the valve stem 34. Thus, when the release valve 30 is opened, the charge valve member 84 opens. Preferably, the stem 83 includes a knob 83*a* on the free end. When the cartridge 8 is inserted into the receiver 82, the sliding charge valve member 84 remains in the closed position. The stem 83 is sized such that, when the trigger 32 is pulled and the valve stem 34 opens the valve 30, the stem 83 is directed rearward and the knob 83a engages the extension 84*a* of the sliding charge valve member 84, forcing the sliding charge valve member 84 to a second, open position, to open the opening 90. Pressurized fluid inside the cartridge bottle 9 can then travel through the opening 88 of the charge valve assembly 80, into the receiver 82 of the manifold 26 and the conduit 28, past the now open gun release valve 30 for discharge from the nozzle 18. The same open flow path allows water under pressure to be forced into the cartridge bottle 9 when it is mounted on the gun and when the recharge adapter 130 or 230 is used to charge the cartridge bottle 9 with water from an external pressurized water source, such as a municipal water supply.

Figure 5A:
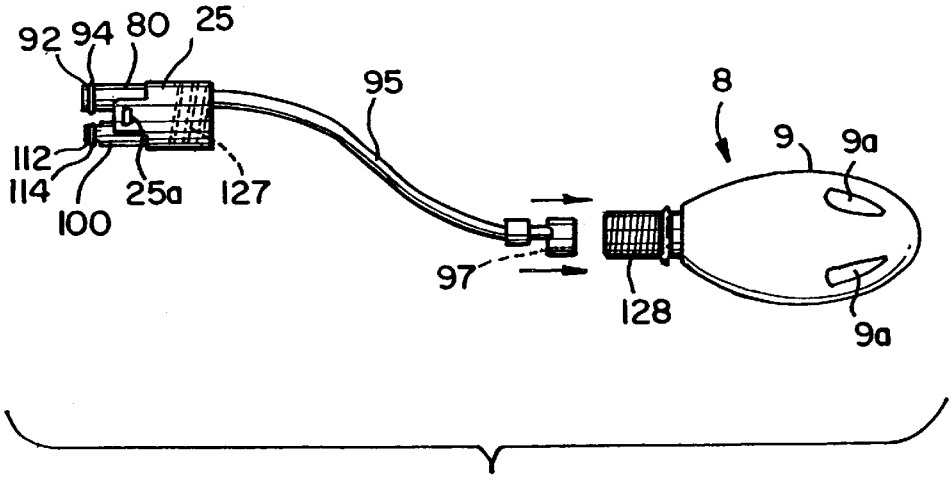
FIG. 5A is an exploded view better illustrating the components of an air pressurizable fluid cartridge according to the present invention.
Figure 6:
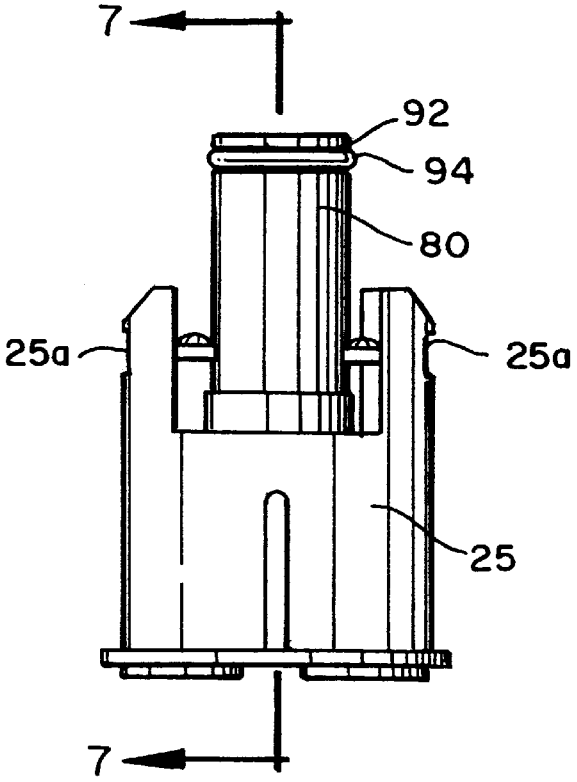
FIG. 6 is a top plan view of the cartridge manifold, shown unthreaded from the cartridge bottle.

As best seen in FIGS. 2 and 5A, a flexible fill tube 95, preferably but not necessarily, extends into the cartridge bottle 9 from the charge valve assembly housing 90 for transferring fluid between the cartridge bottle 9 and the charge valve assembly 80. A filter screen assembly 97 is preferably connected to an end of the flexible tube 95, distal from the charge valve assembly 80. If desired, the tube 95 could be eliminated and the charge valve assembly would then be in direct fluid communication at its rear end with the interior of the cartridge bottle 9.

Still with reference to FIGS. 2 and 7 the pump valve assembly 100 is connectable with and preferably insertable into a pump valve assembly receiver 102 in the gun manifold 26. The pump valve assembly housing 110 includes a groove 112 for an O-ring seal 114 at the forward end. This assures a leak-free seal between the pump valve assembly housing 100 and the pump valve receiver 102. The charge valve assembly 80 and the pump valve assembly 100 arc sized differently so that they can only be received within the charge valve receiver 82 and the pump valve receiver 102, respectively.

The pump valve assembly receiver 102 includes a stem 103 which extends into the pump valve assembly 100 and forces the pump valve assembly 100 to an open position when the pump valve assembly 100 is inserted into the pump valve assembly receiver 102 as the cartridge 8 is installed in the cartridge receiver 23. A sliding pump valve member 104 is located in the pump valve assembly 100. A ring seal 105 with a central opening 105*a* is located on the pump valve member 104 between the pump valve member 104 and a pump valve assembly housing 110 to provide a seal between the pump valve member 104 and the pump valve assembly housing 110 when the pump valve member 84 is biased into a first, forward most, normally closed position by a fifth spring 106. The pump valve member 104 includes a pump valve opening 108, preferably in the form of at least one channel, and preferably a plurality of channels, located around the periphery of the sliding pump valve member 104, between the sliding pump valve member 104 and the pump valve assembly housing 110. When the cartridge 8 is removed from the cartridge receiver 23, the sliding pump valve member 104 is biased back into the closed position by the spring 106, since the stem 103 will no longer be forcing the sliding pump valve member 104 into the open position. Thus, when the cartridge 8 is removed from the gun 10, even if the cartridge bottle 9 is charged with water and air, since the charge valve member 84 and the pump valve member 104 are both closed, the cartridge bottle 9 will continue to retain the water and air therein without leaking.

It will be recognized by those skilled in the art from the present disclosure that different types of pump valve assemblies can be utilized, if desired.

Still with reference to FIGS. 2 and 7, preferably, a cartridge pressure release valve 120 having a seal 124 is located inside the sliding pump valve member 104 and within the pump valve assembly housing 110. The cartridge pressure release valve 120 is set at a desired pressure in order to prevent over-pressurization of the cartridge 8. The cartridge pressure release valve 120 allows for quick charging of the water gun 10 using an external source of pressurized water, such as pressurized tap water provided by a well pump or water pressure from a municipal water supply, without the risk of over-pressurizing the gun or bottle cartridge 9, as explained in detail below.

Preferably, the cartridge pressure release valve 120 includes a pressure adjustment cap 107 having a central opening 109 aligned with the opening 105*a* in the seal 105 for the pressure valve member 104. The pressure adjustment cap 107 preferably has screw threads on its outer periphery that mate with screw threads on the inner periphery of the pressure valve member 104. This allows the pressure adjustment cap 107 to be screwed into or out of the pressure valve member 104 to adjust the force exerted by a sixth spring 122 which biases the cartridge pressure release valve 120 to a normally closed position, such that the seal 124 seals an opening 125 in the rear wall of the pump valve member 104. When the pressure release valve 120 is opened, the opening 125 is in fluid communication with the interior of the cartridge bottle 9. The pressure adjustment cap 107 is screwed into the pump valve member 104 to an extent that the force on the spring 122 is adjusted to have a desired opening force to open the pressure release valve 120 when the cartridge pressure release valve 120 is acted upon by a sufficient amount of pressure from within the cartridge bottle 9. This pressure is the release pressure and represents the maximum desirable pressure within the cartridge bottle 9. Alternatively, instead of providing a pressure release cap 107 to allow for adjusting the release pressure, the sixth spring 122 can be calibrated to provide a predetermined release pressure at which the pressure release valve will open.

It will be recognized by those skilled in the art from the present disclosure that different types of cartridge pressure release valve assemblies can be utilized, if desired.

With the cartridge 8 installed in the cartridge receiver 23 of the toy gun 10, the stem 103 forces the pump valve assembly 100 to the open position. Fluid inside the cartridge 8 and cartridge bottle 9 is released from the cartridge 8 and drains through the pump pipe 54 and to the pump pressure release valve 60. In the event that the fluid is over pressurized, the pump pressure release valve 60 opens, allowing the over-pressurized water to drain out the vent opening 12*a*.

The water gun 10 can be charged through the recharge adapter 130 or 230 which is adapted to be connected to an external source of pressurized water, such as public water, by placing either the nozzle assembly 64 of the toy gun 10 or the charge valve assembly 80 of a separated cartridge 8 into the recharge adapter 130 or 230.

Figure 9:
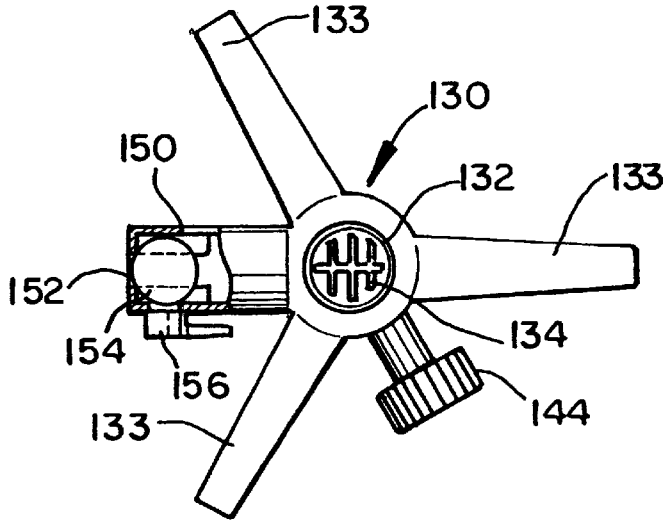
FIG. 9 is a top plan view of the recharge adapter in accordance with the present invention.

As shown in detail in FIGS. 3, 4, and 9, the recharge adapter 130 includes a receptacle 132 for receiving either the nozzle assembly 64 of the water gun 10 or the charge valve assembly 80 on the cartridge 8. For purposes of illustration, FIGS. 3 and 4 depict the charging of the gun 10 through the nozzle assembly 64. A plurality of legs 133 allow the recharge adapter 130 to be placed on a flat surface for use. A valve body 134 is slidably located in the receptacle 132 and is held in a normally closed position against a seat 138 via a seventh spring 136 located in the receptacle 132. A seal is provided via an O-ring seal 140. A fluid channel 142 is located in the valve body 134 such that upon downward movement of the valve body 134, to the position shown in detail in FIGS. 3 and 4, caused by the insertion of the nozzle of the water gun or cartridge being charged, water under pressure enters the fluid channel 142 and is conveyed through the valve body 134 to either the nozzle assembly 64 of the gun 10 or the charge valve assembly 80 of the cartridge 8. Water pressure from the external source forces the sliding nozzle member 68 inward, opening the recharge channels 74 into fluid communication with the fluid path 142 in the recharge adapter 130. The recharge adapter 130 is adapted to force fluid through the nozzle assembly 64, the valve 30 and the first path of fluid communication and into the cartridge 8, pressurizing air within the cartridge bottle 9 to charge the cartridge 8. When used for charging the cartridge 8 directly through the charge valve assembly 80 when the cartridge 8 is removed from the water gun 10, the procedure would be the same as described below with respect to the recharge adapter 230.

An external hose attachment 144, shown in FIGS. 3 and 9, is provided on the recharge adapter 130 for connection to an external source of pressurized water, such as a garden hose. However, it will be recognized by those skilled in the art from the present disclosure that other types of connectors or couplings can be provided for attaching the recharge adapter 130 to a pressurized water source, such as a municipal water supply. It will be similarly recognized that the different types of valves and actuating mechanisms can be used.

As shown in FIG. 9, a secondary charge source 150 in the form of a valve preferably extends from the recharge adapter 130. The secondary charge source 150 includes an outlet 152 which fluidly connects the external source of fluid to the environment or to another hose through any appropriate fitting, not shown, if desired. A valve 154 is located within the path of fluid communication between the outlet 152 and the external source of fluid and is operable between an open and closed position Preferably, the valve 154 is a ball valve, although those skilled in the art will recognize in view of the present disclosure that other types of valves can be used. A handle 156, operatively connected to the valve 154, extends from the secondary charge source 150. The secondary charge source 150 allows the external source of fluid to be discharged from the recharge adapter 130, for example, to fill a cartridge bottle 9 that has been removed from the cartridge 8 or other types of water guns or any other container or for other use as desired, without receiving either of the nozzle assembly 64 or the charge valve assembly 80 in the recharger receptacle 132.

The recharge adapter 130 or quick charge device is preferably made from polymeric material in one or more pieces to be assembled. However, it is understood and recognized by those skilled in the art from the present disclosure that the recharge adapter 130 or quick charge device may be made using any desired method, and from any suitable material, as desired.

Figure 10:
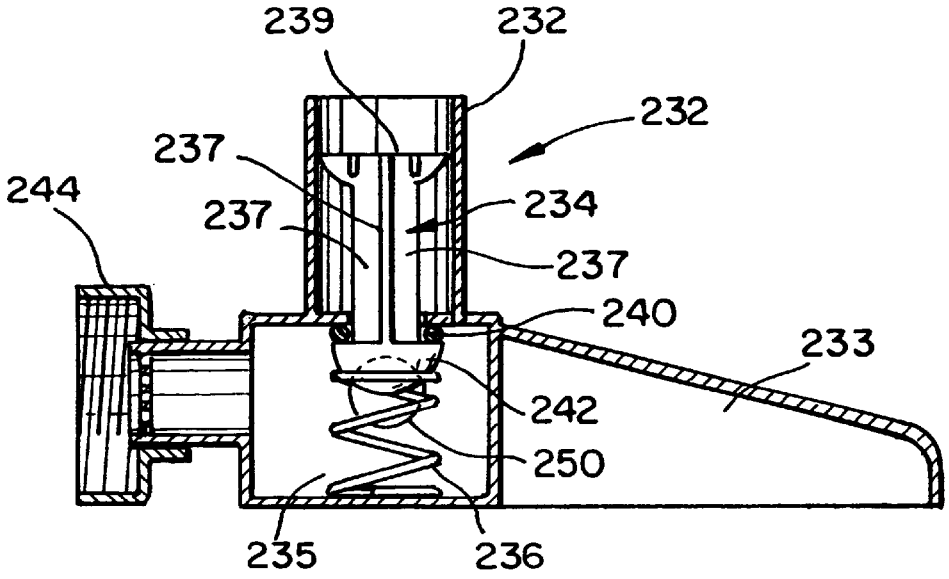
FIG. 10 is a vertical cross-sectional view of another preferred embodiment of a recharge adapter in accordance with the present invention.
Figure 11:
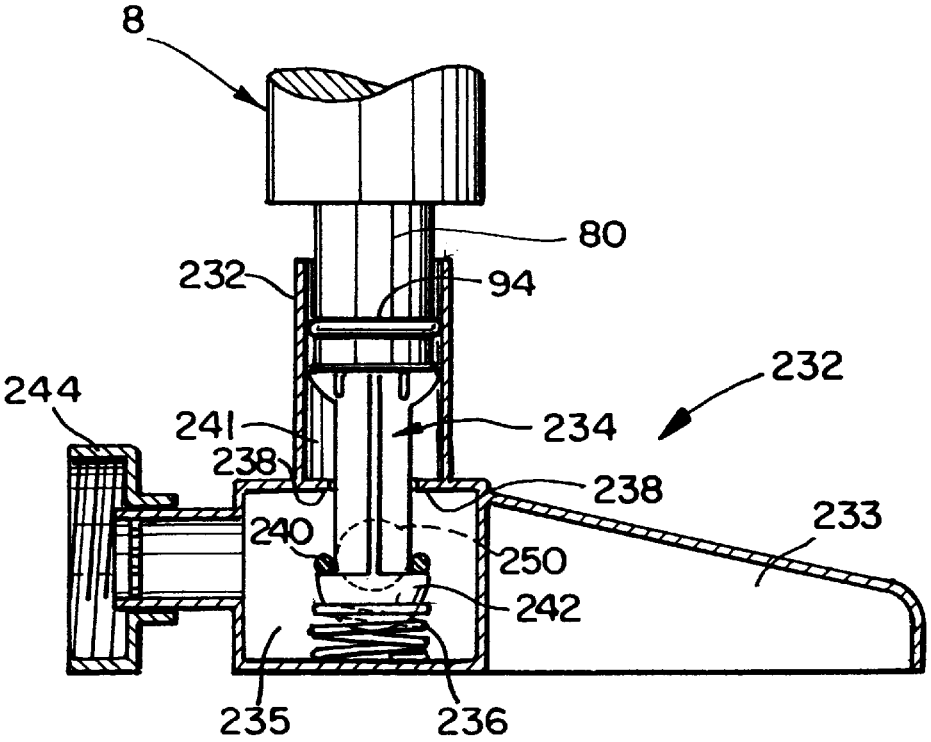
FIG. 11 is a vertical cross-sectional view of the nozzle of the charge valve assembly of a cartridge used in the toy water gun shown in FIG. 1 being inserted into the recharge adapter of FIG. 10 in accordance with the present invention.

An alternative and presently preferred embodiment of a valve member for a recharge adapter that otherwise is made and used in the same way as recharge adapter 130 is shown with respect to the alternative embodiment of a recharge adapter 230 in FIGS. 10 and 11.

The recharge adapter 230 has the appearance in a top plan view the same as the recharge adapter 130 shown in FIG. 9, and so is not separately illustrated. The recharge adapter 230 includes a receptacle 232 for receiving either the nozzle assembly 64 of the water gun 10 or the charge valve assembly 80 on the cartridge 8. For purposes of illustration, FIG. 11 depicts the adapter in use to charge the cartridge 8 through the charge valve assembly 80. A plurality of legs 233 allow the recharge adapter 230 to be placed on a flat surface for use. A valve body 234 is slidably located in the receptacle 232 and is held in a normally closed position against a seat 238 via a spring 236 located in a valve chamber 235. A seal is provided via an O-ring seal 240.

A fluid channel 241 is formed around the open valve body 134, by virtue of the construction of the valve body in the form of a plurality of crossed vanes 237 connected together at their central intersection, having a level top 239 and an opposed bottom structure 242 for supporting the O-ring seal 240 and the spring 236. Upon downward movement of the valve body 234 to the position shown in detail in FIG. 11, caused by the insertion of the nozzle of the water gun or cartridge being charged, water under pressure enters the fluid channel 241 and is conveyed around the valve body 234 to either the nozzle assembly 64 of the gun 10 or, as shown in FIG. 11, the charge valve assembly 80 of the cartridge 8. Water pressure from the external source forces the sliding charge valve member 84 (not shown in FIG. 11; see FIG. 7) inward, opening the recharge channels 88 into fluid communication with the fluid path 241 in the recharge adapter 230. The recharge adapter 230 is adapted to force fluid through the charge valve assembly 80 and into the cartridge 8, pressurizing air within the cartridge bottle 9 to charge the cartridge 8. When used for charging the water gun 10 through the nozzle assembly 64, the procedure would be the same as described above with respect to the recharge adapter 130.

An external hose attachment 244 is provided on the recharge adapter 230 for connection to an external source of pressurized water, such as a garden hose. However, it will be recognized by those skilled in the art from the present disclosure that other types of connectors or couplings can be provided for attaching the recharge adapter 230 to a pressurized water source, such as a municipal water supply. It will be similarly recognized that the different types of valves and actuating mechanisms can be used.

A secondary charge source 250 in the embodiment of the recharge adapter 230 has the same components and operates in the same manner as discussed above with respect to the secondary charge source 150 for the recharge adapter embodiment 130 of FIGS. 3, 4 and 9. Therefore, there is no need to repeat that information here.

The recharge adapter 230 or quick charge device is preferably made from polymeric material in one or more pieces to be assembled. The valve body 234 is preferably made as a single unitary piece by an injection molding technique or any other suitable molding technique, using appropriately durable polymeric material. However, it is understood and recognized by those skilled in the art from the present disclosure that the recharge adapter 130 or quick charge device may be made using any desired method, and from any suitable material, as desired.

In operation, the water gun 10 can be charged by filling and pressurizing the storage cartridge 8 by one of four methods. In a first method, the water gun 10 can be filled and pressurized by inserting the nozzle assembly 64 into the receptacle 132 of the recharge adapter 130 or into the receptacle 232 of the recharge adapter 230. This insertion displaces the normally closed valve body 134 or 234 to an open position by moving it downwardly upon contact by the nozzle assembly 64, opening the fluid channel 142 or 241. Water under pressure from an external source which is connected to the recharge adapter 130 or 230 then flows through valve body 134 of the recharge adapter 130 or around the vanes 237 of the valve body 234 of the recharge adapter 230, into the nozzle assembly 64 and presses the sliding nozzle member 68 inwardly to allow a larger volume of water to flow through the recharge channel 74 located on the sliding nozzle member 68. The sliding nozzle member 68 is opened via water pressure acting on the closing surface of the sliding nozzle member 68 or mechanically upon insertion of the nozzle assembly 64 into the recharge adapter 130 or 230 in order to allow a flow of pressurized water through the sliding nozzle member 68.

The gun release valve 30 is also opened via water pressure acting on the gun release valve 30 in order to allow fluid to flow around the gun release valve 30 and through the conduit 28 and into the manifold 26. Water flows through the water gun manifold 26 and the cartridge manifold 25 and into the charge valve assembly 80. The water then flows against the sliding charge valve member 84. The force of the water overcomes the force of the fourth spring 86 and opens the sliding charge valve member 84. The water then flows through the recharge channels 88 and into the cartridge bottle 9, trapping and pressurizing air above the water in the cartridge bottle 9 to pressurize the cartridge bottle 9 with liquid under pressure The pump valve member 104 is biased to an open position by the stem 103, allowing the pressurized fluid to flow through the pump pipe 54 to the pump pressure release valve 60, which opens in the case of over-pressurization.

When the water gun 10 is fully charged, the nozzle assembly 64 is removed from the recharge adapter 130 or 230 This pressurized air provides the motive force, upon activation of the release valve 30, for shooting water from the gun 10 in a similar manner to the pressurized air water gun disclosed in U.S. Pat. No. 5,074,437. The pump pressure release valve 60 prevents over-pressurization and allows water to overflow from the cartridge 8 if the water pressure from the external water source is above the set value for the pump pressure release valve 60 in order to prevent over-pressurization of the water gun 10 and its components. Once the cartridge 8 is pressurized, movement of the trigger 32 opens the gun release valve 30 and moves the stem 83 against the charge valve member 84, opening the charge valve member 84 and releasing the pressurized water or fluid from the cartridge 8 and out of the nozzle assembly 64 as a burst of fluid, preferably water.

In a second method, the cartridge 8 can be filled directly from the recharge adapter 130 or 230 without being retained within the gun 10. The charge valve assembly 80 of the cartridge 8, which has been removed or separated from the housing 12, is inserted into the receptacle 132 of the adapter 130 or the receptacle 232 of the adapter 230 in a manner similar to the manner in which the nozzle assembly 64 of the gun 10 is inserted into the recharge adapter 130 or 230. This moves the normally closed valve body 134 or 234 to the open position by moving it downwardly upon contact by the charge valve assembly 80 and allows water under pressure to flow through the recharge adapter 130 or 230, through the charge valve assembly 80 and press the sliding charge valve member 84 inwardly to allow water to flow through the sliding charge valve channel 88 located on the sliding charge valve member 84. The sliding charge valve member 84 is opened via water pressure acting on the closing surface of the sliding charge valve member 84 or may be opened mechanically upon insertion of the charge valve assembly 80 into the recharge adapter 80 in order to allow a flow of pressurized water through the recharge adapter 130 and into the cartridge 8. Air already in the cartridge 8 is trapped in the cartridge 8 and is compressed by the pressurized water flowing into the cartridge 8. When the cartridge 8 is fully charged, the cartridge 8 is removed from the recharge adapter 130. In the event that the cartridge 8 is over-pressurized, the cartridge pressure release valve 120 is forced open, allowing excess pressure to be released from inside the cartridge 8.

Additional cartridges 22 can be charged in the same manner. A charged cartridge 8 is inserted into the rear of the gun 10, as shown in FIG. 1A, and into the quick release connector 24 with the charge valve assembly 80 inserted into the receiver 82 and the pump valve assembly 100 inserted into the pump valve assembly receiver 102. The gun 10 is then ready for use. Additional spare cartridges 8 can be loaded in this manner.

When the charged cartridge 8 has been sufficiently depleted to a point where pressure inside the cartridge 8 is no longer sufficient to discharge the water from the cartridge 8, the user can remove the "spent" cartridge 8 and insert a fully charged cartridge 8 without returning to a water source. To remove a spent cartridge 8 from the gun 10, the user depresses the free ends 27*b* of the lock arms 27 toward the cartridge 8. The free ends 27*a* of the lock arms 27 pivot away from the cartridge 8, and the tangs 29 are disengaged from the notches 25*a*, releasing the cartridge 8 to be removed from the gun 10.

Alternatively, if water remains in the cartridge 8, but the cartridge 8 is not pressurized sufficiently with air to effectively discharge the water, the user can operate the pump 50 and pump air into the cartridge 8 to repressurize the cartridge 8. Operation of the pump 50 forces air into the second path of fluid communication, namely, the pump pipe 54, the gun manifold 26 and cartridge manifold to the cartridge 8 and into the cartridge bottle 9. If the cartridge 8 becomes over-pressurized due to excessive pumping or excessive pressure from a pressurized water source, the pump pressure release valve 60 opens, releasing over-pressurized air from the vent opening 12*a* in the housing 12.

In a third method, the quick release connection 24 is opened and the cartridge 8 is removed from the housing 12. The cartridge manifold 25 is removed from the bottle 9 by unthreading from the threads 127 and the cartridge bottle 9 is filled with unpressurized fluid, preferably water. The cartridge manifold 25 is then rethreaded onto the cartridge bottle 9, and the cartridge 8 is inserted into the quick release connection 24 in the housing 12. The pump 50 is then operated to pump air into the cartridge 8, pressurizing the cartridge 8 as described above.

In a fourth method, the user opens the valve 154 in the recharge adapter 130 or 230 and allows the pressurized fluid to be released from the secondary charge source 150 or 250 and into a container, such as a cartridge bottle 9 with the cartridge manifold 25 having been removed from the cartridge bottle 9. Alternatively, the secondary charge source 150 or 250 can be used to fill other types of cartridges for use in other toy water guns or other devices.

Water is released from the water gun 10 by pulling the trigger 32, which moves the arm 42 rearwardly, operating the actuator trolley 44 to compress the delay spring 46 to such a point where the valve stem 34 rapidly opens the release valve 30 in order to release a burst of water through the opening in the nozzle 18 of the nozzle assembly 64. The pump 50 can be used to keep air pressure up for longer shots. Water in the cartridge 8 can be pressurized via the pump 50 in the known manner.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. A toy gun for discharging a fluid under pressure, the toy gun comprising:

a housing;

a trigger movably connected to the housing;

a pre-pressurizable fluid storage cartridge removably connected to the housing, the fluid storage cartridge being pressurizable with a fluid prior to connecting the fluid storage cartridge to the housing;

a release valve fluidly connected to the fluid storage cartridge and connected to the trigger to permit a discharge of fluid from the toy gun;

a nozzle in fluid communication with the release valve; and a path of fluid communication connected between the fluid storage cartridge and the release valve;

wherein operation of the trigger discharges pressurized fluid from the fluid storage cartridge through the path of fluid communication and through the nozzle.

2. The toy gun as claimed in claim 1, wherein the nozzle is adapted for insertion into a quick charge device which is adapted to force fluid from the quick charge device through the nozzle and the path of fluid communication and into the fluid storage cartridge to pressurize fluid within the storage cartridge.

3. The toy gun as claimed in claim 1, further comprising a pump connected to the housing and in fluid communication with the fluid storage cartridge, the pump being adapted to transfer air to the fluid storage cartridge.

4. The toy gun as claimed in claim 3, wherein the pump includes a pump handle adapted for manual actuation by a user.

5. The toy gun as claimed in claim 2 wherein the cartridge includes a charge valve assembly.

6. The toy gun as claimed in claim 5, wherein the charge valve assembly is connectable to a receiver in the housing and to the quick charge device.

7. The toy gun as claimed in claim 1, wherein the nozzle is part of a nozzle assembly and the nozzle assembly further comprises a discharge opening of a first size and a recharge opening of a second size, larger than the first size.

8. The toy gun as claimed in claim 1, wherein the nozzle assembly further comprises a nozzle housing and a sliding nozzle member slidably disposed in the nozzle housing, the sliding nozzle member including the discharge opening and at least one channel formed between the sliding nozzle member and the nozzle housing.

9. The toy gun as claimed in claim 1, wherein a pressure release valve is connected to the path of fluid communication.

10. The toy gun as claimed in claim 1, wherein the pump includes a pump valve assembly and is configured such that the pump handle extends from a front of the gun and can be grasped by a user to manually pump air into the fluid storage cartridge.

11. The toy gun as claimed in claim 1, wherein the cartridge includes a charge valve assembly.

12. The toy gun as claimed in claim 11, wherein the cartridge includes an over-pressure relief valve.

13. The toy gun as claimed in claim 1 wherein the housing includes a quick release locking device releasably securing the cartridge to the housing.

14. A toy gun system adapted to discharge a stream of liquid under pressure, comprising:

a toy gun and a recharging adapter, the toy gun including:
- a housing;
- a nozzle assembly at a discharge end of the housing;
- a pump connected to the housing;
- a pre-pressurizable fluid storage cartridge removably connected to the housing;
- a path of fluid communication connected between the fluid storage cartridge and the nozzle; and the recharging adapter including:
- a receptacle adapted to receive the nozzle assembly;
- a valve body slidably disposed in the receptacle;
- a fluid channel located in the valve body; and
- a connector adapted for connection to an external source of pressurized liquid,
  - wherein insertion of the nozzle assembly of the toy gun into the receptacle of the recharging adapter displaces the valve body to an open position, and allows fluid from an external source of pressurized fluid to travel through the valve body, the nozzle assembly and the path of fluid communication and into the fluid storage cartridge, pressurizing fluid in the storage cartridge
  - and wherein insertion of the charge valve assembly of the cartridge, which has been removed from the toy gun housing, into the receptacle of the recharge adapter allows fluid from the external source of pressurized fluid to travel through the charge valve assembly and into the fluid storage cartridge, pressurizing fluid in the storage cartridge.

15. The toy gun system as claimed in claim 14, wherein the nozzle assembly comprises a nozzle housing, a sliding nozzle member slidably disposed in the nozzle housing, a nozzle opening in the sliding nozzle member, and at least one channel between the sliding nozzle member and the nozzle housing.

16. The toy gun system as claimed in claim 15, wherein the nozzle opening has a size that is smaller than the at least one channel.

17. The toy gun system as claimed in claim 16, wherein the sliding nozzle member is movable from a first position in which the at least one channel is closed to a second position during recharging, in which the at least one channel is open, the sliding nozzle member being normally biased to the first position.

18. The toy gun system as claimed in claim 14, wherein a pressure release valve is provided in fluid communication between the cartridge and the pump.

19. The toy gun system as claimed in claim 18, wherein the path of fluid communication communicates with a valve assembly connected to the pump.

20. The toy gun as claimed in claim 14 wherein the cartridge includes a charge valve assembly.

21. The toy gun as claimed in claim 20, wherein the charge valve assembly is connectable to a receiver in the housing and connectable to the recharge adapter.

22. The toy gun as claimed in claim 14, wherein the cartridge includes a pump valve assembly.

23. The toy gun as claimed in claim 22, wherein the pump valve assembly includes an over-pressure release valve.

24. A method of operating a toy gun system comprising the steps of:

(a) providing a toy gun having a housing, a pre-pressurizable fluid storage cartridge removably connected to the housing and being pressurizable with a fluid prior to connecting the fluid storage cartridge to the housing, and the toy gun further having a charge valve assembly, a nozzle, a pump, and a path of fluid communication between the cartridge, the nozzle, and the pump;

(b) pressurizing air within the fluid storage cartridge by at least one of:
- (i) pumping air via the pump to the fluid storage cartridge;
- (ii) inserting the nozzle in a receptacle of a recharging adapter and allowing pressurized fluid to flow from the recharging adapter through the nozzle and into the fluid storage cartridge; and
- (iii) inserting the charge valve assembly of the fluid storage cartridge which has been removed from the housing into the receptacle of the recharging adapter and causing the charge valve assembly to open to allow pressurized fluid to flow from the recharging adapter into the fluid storage cartridge, removing the fluid storage cartridge from the recharging adapter and inserting the fluid storage cartridge into the gun;

(c) discharging the cartridge by displacing the release valve via a trigger connected to the release valve to eject a stream of fluid from the toy gun; and (d) recharging the toy gun in accordance with step (b).

* * * * *